US007188435B2

(12) United States Patent
Woolston et al.

(10) Patent No.: US 7,188,435 B2
(45) Date of Patent: Mar. 13, 2007

(54) KNOCK-DOWN TYPE DRYER ASSEMBLY FOR PROSTHESIS LINERS

(76) Inventors: Bonnie E. Woolston, 3808 Ogilvie Ct., Woodbridge, VA (US) 22192; Alan E. Young, 7518 Axton St., Springfield, VA (US) 22151

( * ) Notice: Subject to any disclaimer, the term of this patent is extended or adjusted under 35 U.S.C. 154(b) by 55 days.

(21) Appl. No.: 11/184,850

(22) Filed: Jul. 20, 2005

(65) Prior Publication Data

US 2007/0017115 A1 Jan. 25, 2007

(51) Int. Cl.
*F26B 7/00* (2006.01)

(52) U.S. Cl. ..... 34/381; 34/104; 34/174; 34/195

(58) Field of Classification Search ..... 34/104, 34/381, 174, 194
See application file for complete search history.

(56) References Cited

U.S. PATENT DOCUMENTS

| | | | | |
|---|---|---|---|---|
| 426,111 | A | 1/1890 | Coffin | |
| 686,314 | A | 11/1901 | Mansfield | |
| 1,046,514 | A | 12/1912 | Vogel | |
| 1,281,927 | A | 10/1918 | Felton | |
| 1,411,876 | A | 4/1922 | Schwartz, Jr. | |
| 1,444,264 | A | 2/1923 | O'Neill | |
| 1,906,553 | A | 5/1933 | Dennis | |
| 1,913,542 | A | 6/1933 | Guggenheim | |
| 4,171,580 | A | 10/1979 | Vabrinskas | |
| 5,334,691 | A * | 8/1994 | Gould et al. | 528/76 |
| 5,376,127 | A | 12/1994 | Swanson | |
| 5,387,245 | A * | 2/1995 | Fay et al. | 623/37 |
| 5,802,735 | A * | 9/1998 | Schoonhoven | 34/174 |
| 5,888,216 | A | 3/1999 | Haberman | |
| 6,085,436 | A | 7/2000 | Peet | |
| 6,231,616 | B1 * | 5/2001 | Helmy | 623/34 |
| 6,327,792 | B1 | 12/2001 | Hebert | |
| 6,553,687 | B1 | 4/2003 | Leamon, Jr. | |
| 6,802,136 | B2 | 10/2004 | Merchant | |
| 2002/0088384 | A1 | 7/2002 | Bernhardt | |
| 2004/0064963 | A1 | 4/2004 | Marolt | |

* cited by examiner

*Primary Examiner*—S. Gravini
(74) *Attorney, Agent, or Firm*—Diederiks & Whitelaw, PLC

(57) ABSTRACT

A knock-down type dryer assembly for prosthesis liners includes a housing mounted on a base member and a prosthesis liner support detachably mounted to the housing. The prosthesis liner support comprises a cross-member detachably coupled to an arm member and includes adjustable side wing portions that allow a user to adjust for the size of a particular prosthesis liner. When activated, an electrical fan in the housing draws ambient air into the housing and directs it up through the prosthesis liner where it circulates before exiting the liner. An anti-microbial lamp within the housing can be utilized to help rid the prosthesis liner of harmful bacteria. The manner in which the liner support is assembled, and the manner in which the liner support detachably connects to the housing, allows a user to easily assemble and disassemble the liner dryer and encourages proper cleaning/drying of the prosthesis liner before use.

20 Claims, 2 Drawing Sheets

KNOCK-DOWN TYPE DRYER ASSEMBLY FOR PROSTHESIS LINERS

BACKGROUND OF THE INVENTION

1. Field of the Invention

The present invention pertains to the art of prosthetics and, more specifically, to a knock-down type prosthesis liner dryer.

2. Discussion of the Prior Art

Many people who have missing or partially missing limbs rely upon prosthetic devices. When a person is fitted for a limb prosthesis, a limb liner is typically placed over the end of the limb or the limb stump. The liner conforms to the shape of the limb stump and creates a strong frictional attachment to the skin of the wearer. In many cases, a metal locking pin extends from the tip of the limb liner and is used for attaching a prosthetic limb. Current liners are typically made with silicon or other elastomeric material. Because elastomeric liners are relatively impermeable, the skin of a wearer tends to be constantly moist within the liner. This condition creates the right environment for undesirable bacterial growth, making the wearer's skin susceptible to bacterial infection. Thus it is important for prosthesis liners to be thoroughly washed and dried each day. Even putting on a clean but wet prosthesis liner can aggravate a wearer's skin and encourage conditions for bacterial growth. It is therefore important that a wearer thoroughly dry a prosthesis liner before use.

It is common to find drying devices for circulating hot air through clothing articles, such as footwear or the like, to facilitate drying of the articles. However, such devices cannot be used for elastomeric prosthesis liners, as the liners are sensitive to high temperatures and may be damaged. In particular, prosthesis liners are specific in size to the wearer such that high temperature heated drying would cause the liner to shrink, thereby rendering the liner unusable. For this reason, prosthesis liners are simply allowed to air dry, a process which is extremely time consuming. Based thereon, there exists a need in the art for a drying device for prosthesis liners that can speed up the drying time of the liners without exposing them to damaging conditions.

SUMMARY OF THE INVENTION

The present invention is directed to a knock-down type dryer assembly for prosthesis liners. The dryer assembly includes a liner support detachably mounted to a housing which, in turn, is attached to a base member. The liner support comprises an arm member detachably connected to a cross-member having first and second fin portions. Preferably, adjustable side wings located on the arm member and/or cross-member allow a user to adjust the liner support to accommodate various sized prosthesis liners. A switch on the housing allows a user to activate a fan located within the housing to circulate ambient air from an air inlet portion of the housing, out an air outlet portion of the housing and up through a supported prosthesis liner where the air circulates and is forced down and out of the prosthesis liner. Preferably, an anti-microbial lamp is located in the housing. When utilized, the anti-microbial lamp helps rid the prosthesis liner of potentially harmful bacteria. The manner in which the arm member is detachably connected to the cross-member, and the manner in which the entire liner support is detachably mounted to the housing, creates a dryer assembly which can be easily assembled for use and disassembled for transport and storage.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
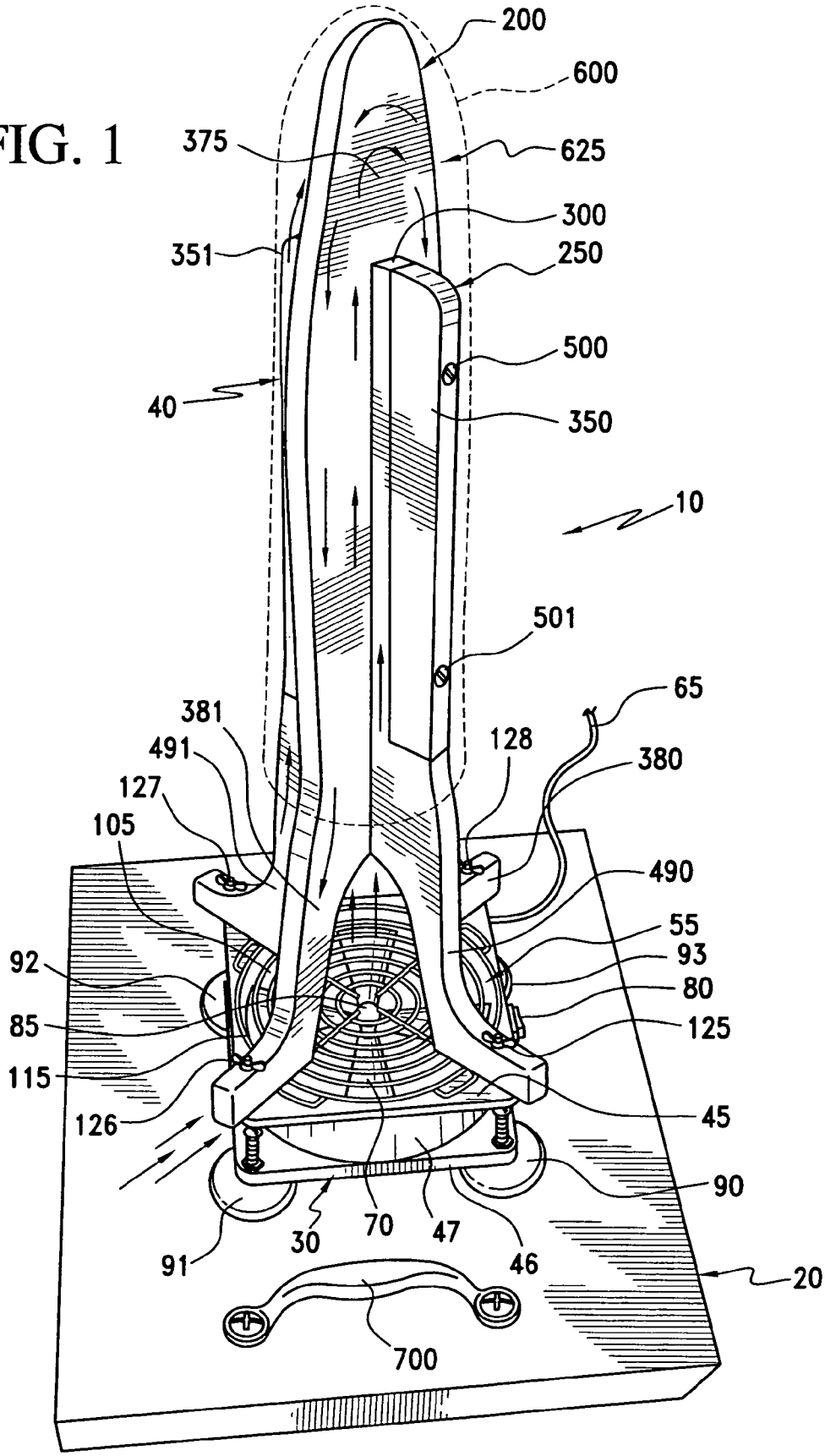
FIG. 1 is a perspective view of a preferred embodiment of the knock-down dryer assembly for prosthesis liners of the present invention.

With initial reference to FIG. 1, a knock-down type dryer assembly 10 for prosthesis liners (hereafter dryer assembly 10) includes a base member 20, a housing 30 and a means for supporting a prosthesis liner such as prosthesis liner support 40. Housing 30 has a top portion 45, a bottom portion 46 and at least one side wall portion 47, which collectively define an interior space 55. An electrical supply cord 65 attached to housing 30 supplies electricity to a fan 70 and a controller (not shown) housed within interior space 55. Preferably, an on/off switch 80 is located on housing 30 for actuating fan 70 and, optionally, an anti-microbial light bulb 85 also extends within interior space 55. A plurality of feet 90–93 are attached to bottom portion 46 of housing 30 and maintain a spaced relationship between bottom portion 46 and base member 20 such that air is allowed to flow between housing 30 and base member 20.

Figure 2:
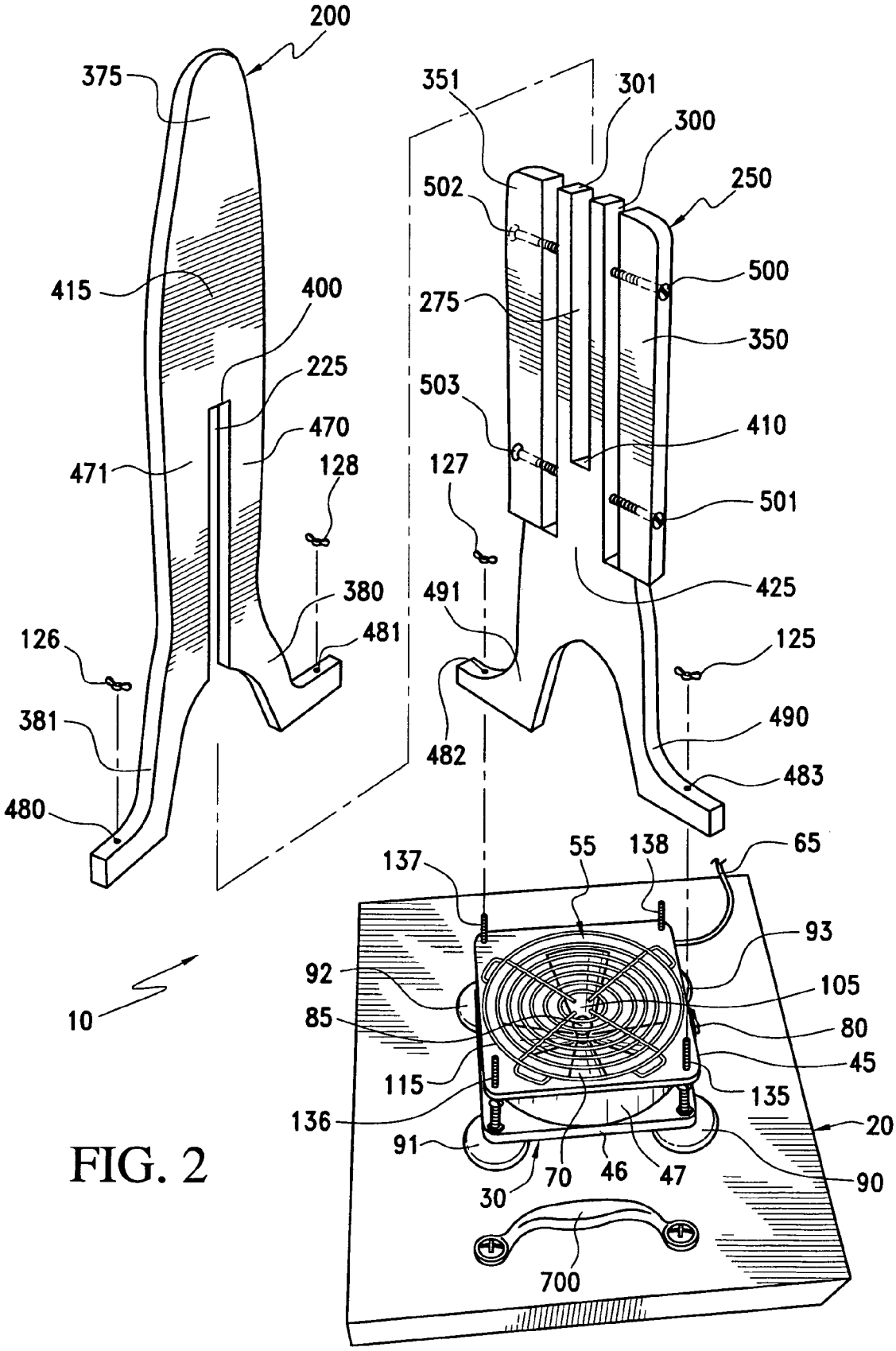
FIG. 2 is an exploded view of the knock-down dryer assembly for prosthesis liners of FIG. 1.

Although depicted as a square block in FIGS. 1 and 2, base member 20 can be any shape or form that stabilizes dryer assembly 10. In any case, bottom portion 46 includes an air inlet portion (not shown). With this arrangement, operation of fan 70, functions to draw ambient air between bottom portion 46 and base member 20, into housing 30 and forces it out through an air outlet portion 105 in top portion 45. A grill 115 may be mounted to top portion 45 of housing 30 to help protect fan 70 while still allowing air to exit housing 30. In addition, although not shown in the figures presented, one or more collar members (not shown) could extend upward from top portion 45 about outlet portion 105 to direct the ambient air to prosthesis liner support 40. Liner support 40 is detachably connected to housing 30 by a plurality of fasteners. The fasteners may be in the form of wing nuts 125–128 and associated bolts 135–138, as depicted in FIGS. 1 and 2, or may be another type of removable fastener, such as hook and loop fasteners, screws, snaps or the like.

With reference to FIGS. 1 and 2, liner support 40 includes an arm member 200 formed with a slot 225, and a cross-member 250 provided with a slot 275 and defining a first fin portion 300 and a second fin portion 301. As depicted, adjustable side wings 350 and 351 are preferably incorporated into or adjustably mounted to respective fin portions 300 and 301 to allow a user to adjust liner support 40 so as to accommodate different sized prosthesis liners as will be detailed more fully below. Housing 30 and liner support 40 are preferably made from lightweight plastics. However, they could be made from wood, metal, or other materials. Arm member 200 is preferably formed such that it tapers from a narrower upper portion generally indicated at 375, to wider lower or leg portions 380 and 381. With this arrangement, liner support 40 advantageously takes a shape complimentary to that of a conventional, tapered prosthesis liner.

In order to assemble and utilize dryer assembly 10, a user initially couples arm member 200 to cross-member 250 by lowering slot 225 over slot 275 until an end surface 400 of arm member 200 abuts an end surface 410 of cross-member 250. When arm member 200 and cross-member 250 are coupled in this manner, a central portion 415 of arm member 200 is held in slot 275 between first and second fin portions 300 and 301 and a central portion 425 of cross-member 250 fits within slot 225 and is sandwiched between upper leg portions 470 and 471 of respective first and second leg members 380 and 381. Preferably, central portion 415 of arm member 200 fits snugly within slot 275 and central portion 425 of cross-member 250 fits snugly within slot 225 such that no additional means are needed to secure arm member 200 to cross-member 250.

Assembled liner support 40 is attached to housing 30 via wing nuts 125–128 and bolts 135–138. More specifically, bolts 135 and 136, which extend upward from housing 30, are inserted through holes 480 and 481 in respective leg members 380 and 381 of arm member 200 and topped with respective wing nuts 125 and 126. Likewise, bolts 137 and 138, which also extend upward from housing 30, are inserted through holes 482 and 483 in respective leg members 490 and 491 of cross-member 250 and topped with respective wing nuts 127 and 128. As indicated above, a user may configure adjustable side wings 350 and 351 to accommodate various liners. In the preferred embodiment shown, adjustable side wing 350 is attached to first fin portion 300 by adjustable screws 500 and 501, while side wing 351 is attached to second fin portion 301 by adjustable screws 502 and 503. In order to adjust the size of liner support 40, a user simply turns screws 500–503 until the desired distance is established between adjustable side wings 350 and 351 and respective first and second fin portions 300 and 301. Alternatively, first and second fin portions 300 and 301 may be attached to cross-member 275 by spring members (not shown) such that first and second fin portions 300,301 can adjust to the inside diameter of a particular prosthesis liner 600. Although not shown, it is contemplated that more adjustable wing members could also be located on arm member 200 to provide additional adjustment of liner support 40.

A wet prosthesis liner, such as that shown in phantom at 600 in FIG. 1, can now be placed over liner support 40 for drying. Once a user activates fan 70, ambient air is drawn into housing 30 and forced out through air outlet portion 105 and directed up along fins 300 and 301 to a circulating space 625 located above fin portions 300 and 301. In circulating space 625, the air is re-directed back down fins 300 and 301 until exiting prosthesis liner 600. Arrows generally depicting this airflow pattern can be seen in FIG. 1. Anti-microbial bulb 85 can be activated, either through switch 80 or another switch (not shown) before, during or after the activation of fan 70 in order to help rid prosthesis liner 600 of harmful bacteria.

Based on the above description, it should be readily apparent that the manner in which arm member 200 is detachably connected to cross-member 250, and the manner in which the entire liner support 40 is detachably mounted to the housing, creates a dryer assembly 10 which can be both easily assembled for use and disassembled for transport and storage. Additionally, one or more handles 700 may be attached to base 20 to aid a user in transporting and handling dryer assembly 10. With the few number of parts and ease of operation, dryer assembly 10 provides for the efficient circulation of ambient air through prosthesis liner 600 to effectively allow a user to quickly and safely dry, while providing bacterial protection for, prosthesis liner 600. Based on the portability and ease of use, dryer assembly 10 encourages daily cleaning of the liner.

Although described with reference to a preferred embodiment of the invention, it should be readily understood that various changes and/or modifications can be made to the invention without departing from the spirit thereof. For example, although the adjustable side wings are shown with an adjustable screw-type attachment to respective cross-members, it is contemplated that other types of adjustable attachments could be employed in order to accommodate a wide range of varying sized prosthesis liners. In addition, housing 30 can have any number of air inlet/air outlet configurations and should not be limited by the detailed description above. Furthermore, it should be understood that the manner in which prosthesis liner support 40 attaches to dryer assembly 10 should not be limited to the configuration shown. For example, prosthesis liner support 40 could be detachably coupled to base member 20 rather than housing 30. In general, the invention is only intended to be limited by the scope of the following claims.

We claim:

1. A knock-down type dryer assembly for prosthesis liners comprising:

a housing having a top, a bottom and at least one side wall portion, the top, bottom and side wall portions collectively defining an interior space, the housing further including an air inlet through which ambient air can enter the housing and an air outlet through which ambient air can exit the housing;

an electrical fan located within the interior space of the housing; and a liner support sized for receiving a prosthesis liner, said liner support being detachably mounted relative to said housing wherein, upon placement of a wet prosthesis liner upon the liner support and activation of the fan, ambient air is drawn in the air inlet and expelled through the air outlet onto the wet prosthesis liner for drying the wet prosthesis liner.

2. The knock-down type dryer assembly according to claim 1, further comprising a handle for transporting at least a portion of the knock-down type dryer assembly.

3. The knock-down type dryer assembly according to claim 1, further comprising an anti-microbial light which, when activated, directs light onto a prosthesis liner placed on the liner support to aid in ridding the prosthesis liner of potentially harmful bacteria.

4. The knock-down type dryer assembly according to claim 1, further comprising a base member having an upper surface, said housing being supported by the base member at a position spaced from the upper surface wherein, during operation of the fan, ambient air is drawn into the air inlet between the top surface of the base and the housing.

5. The knock-down type dryer assembly according to claim 1, wherein the liner support comprises a cross-member and an upstanding arm member detachably coupled to the cross-member, said cross-member and said arm member defining fins for both supporting a prosthesis liner and guiding the ambient air.

6. The knock-down type dryer assembly according to claim 5, wherein the arm member tapers longitudinally from a wider lower portion to a narrower upper portion so as to complement the shape of a prosthesis liner.

7. The knock-down type dryer assembly according to claim 5, wherein the cross-member includes first and second fin portions and at least one adjustable side wing movably mounted to one of said first and second fin portions, said at least one side wing being selectively repositionable to accommodate different sized prosthesis liners on the support assembly.

8. A knock-down type dryer assembly for prosthesis liners comprising:

a housing having a top, a bottom and at least one side wall portion, the top, bottom and side wall portions collectively defining an interior space, the housing further including an air inlet through which ambient air can enter the housing and an air outlet through which ambient air can exit the housing;

an electrical fan located within the interior space of the housing; and means for supporting a prosthesis liner detachably mounted relative to said housing wherein, upon placement of a wet prosthesis liner upon the supporting means and activation of the fan, ambient air is drawn in the air inlet and expelled through the air outlet onto the wet prosthesis liner for drying the wet prosthesis liner.

9. The knock-down type dryer assembly according to claim 8, further comprising a handle for transporting at least a portion of the knock-down type dryer assembly.

10. The knock-down type dryer assembly according to claim 8, further comprising an anti-microbial light which, when activated, directs light onto a prosthesis liner placed on the liner support to aid in ridding the prosthesis liner of potentially harmful bacteria.

11. The knock-down type dryer assembly according to claim 8, further comprising a base member having an upper surface, said housing being supported by the base member at a position spaced from the upper surface wherein, during operation of the fan, ambient air is drawn into the air inlet between the top surface of the base and the housing.

12. The knock-down type dryer assembly according to claim 8, wherein the means for supporting a prosthesis liner comprises a cross-member and an upstanding arm member detachably coupled to the cross-member, said cross-member and said arm member defining fins for both supporting a prosthesis liner and guiding the ambient air.

13. The knock-down type dryer assembly according to claim 12, wherein the arm member tapers longitudinally from a wider lower portion to a narrower upper portion so as to complement the shape of a prosthesis liner.

14. The knock-down type dryer assembly according to claim 12, wherein the cross-member includes first and second fin portions and at least one adjustable side wing movably mounted to one of said first and second fin portions, said at least one side wing being selectively repositionable to accommodate different sized prosthesis liners on the support assembly.

15. A method of using a prosthesis liner dryer comprising:

fitting a prosthesis liner, having an open end and a closed end, over a plurality of fins of a liner support;

activating an electric fan to cause ambient air to flow between the plurality of fins and into the prosthesis liner;

directing the ambient air along an inner surface of the prosthesis liner towards the closed end of the prosthesis liner to dry the prosthesis liner; and exhausting the ambient air by re-directing the ambient air, adjacent the closed end of the prosthesis liner, to flow towards the open end of the prosthesis liner between the plurality of fins.

16. The method of claim 15, wherein the prosthesis liner is dried without heating the ambient air with a heater.

17. The method of claim 15, further comprising activating an anti-microbial light and directing light generated by the anti-microbial light towards the prosthesis liner.

18. The method of claim 15, further comprising varying a size of the liner support prior to fitting the prosthesis liner over the liner support by adjusting at least one side wing of the liner support.

19. The method of claim 15, further comprising pre-assembling the liner support by interconnecting a cross-member to an upstanding arm member prior to fitting the prosthesis liner.

20. The method of claim 19, further comprising mechanically fastening the liner support to a housing of the fan just prior to drying the prosthesis liner.

* * * * *